US008161706B2

(12) United States Patent
Gingras

(10) Patent No.: US 8,161,706 B2
(45) Date of Patent: Apr. 24, 2012

(54) JOINING CLIP FOR MODULAR PANELS

(76) Inventor: Jean-Pierre Gingras, Longueuil (CA)

( * ) Notice: Subject to any disclaimer, the term of this patent is extended or adjusted under 35 U.S.C. 154(b) by 206 days.

(21) Appl. No.: 12/239,068

(22) Filed: Sep. 26, 2008

(65) Prior Publication Data

US 2009/0064622 A1 Mar. 12, 2009

Related U.S. Application Data

(63) Continuation-in-part of application No. 11/743,861, filed on May 3, 2007.

(51) Int. Cl.
*E04B 2/00* (2006.01)

(52) U.S. Cl. ..... 52/582.1; 52/582.2; 52/591.5; 52/284

(58) Field of Classification Search ..... 52/489.2, 52/582.1, 582.2, 698, 699, 700, 712, 715, 52/270, 284, 285.1, 285.3, 293.3; 403/294
See application file for complete search history.

(56) References Cited

U.S. PATENT DOCUMENTS

| | | | | |
|---|---|---|---|---|
| 2,065,525 | A * | 12/1936 | Hamilton | 411/460 |
| 2,129,975 | A * | 9/1938 | Urbain | 52/489.2 |
| 3,196,499 | A * | 7/1965 | Houvener | 52/794.1 |
| 5,373,678 | A * | 12/1994 | Hesser | 52/592.1 |
| 5,509,242 | A | 4/1996 | Rechsteiner | |
| 6,763,643 | B1 * | 7/2004 | Mårtensson | 52/586.1 |

FOREIGN PATENT DOCUMENTS

| | | |
|---|---|---|
| DE | 299 19 825 U1 | 1/2000 |
| EP | 0 887 482 A1 | 12/1998 |

OTHER PUBLICATIONS

European Patent Office—EP 08 01 6958—"Communication"—Transmittal European Search Report and Written Opinion (Form 1507N)—Mar. 11, 2009 (1 page).
European Patent Office—EP 08 01 6958—"European Search Report" dated Mar. 2, 2009 (2 pages).
European Patent Office—EP 08 01 6958—"Written Opinion"—Mar. 11, 2009 (3 pages).

* cited by examiner

*Primary Examiner* — William Gilbert
*Assistant Examiner* — Patrick Maestri
(74) *Attorney, Agent, or Firm* — Benoît & Côté

(57) ABSTRACT

The present document describes a clip for securing a tight connection between two modular panels. The connection has a male portion on a first one of the two modular panels, and a female portion on a second one of the two modular panels. The male portion is for being inserted into the female portion upon assembly of the two modular panels side by side. The clip comprises a first flat member having a first pressure edge, and a second flat member having a second pressure edge. The second flat member is fixedly joined to the first flat member. The panels are assembled in an assembly direction. Upon introduction of the first flat member into the male portion, and of the second flat member into the female portion perpendicularly to the assembly direction, the first pressure edge of the first flat member forces the male portion toward the female portion, while the second pressure edge of the second flat member forces the female portion toward the male portion. These forces secure the tight connection between the two modular panels.

20 Claims, 10 Drawing Sheets

JOINING CLIP FOR MODULAR PANELS

CROSS-REFERENCE TO RELATED APPLICATIONS

This application is filed under 37 CFR 1.53(b) as a continuation-in-part application. This application claims priority under 35USC§120 of U.S. patent application Ser. No. 11/743,861, filed May 5, 2007, and entitled "Customized Modular Panel", the specification of which is hereby incorporated by reference.

TECHNICAL FIELD

This description relates to the field of the construction of rooms or buildings with prefabricated modular panels. More particularly, this description relates to device, for securing insulated panels together.

BACKGROUND

Insulated rooms and refrigeration units are generally constructed using prefabricated insulated modular panels each fabricated either manually or using a continuous manufacturing process.

Modular panels are generally joined together via male and female type joints to form walls, ceilings or floors, for example, of a walk-in cooler structure. These joints are generally secured together using screws and trims or adhesives or cam-lock fasteners which do not provide the most efficient and strong junctions.

There is therefore a need for a solution which efficiently secures modular panels together while also addressing issues associated with the prior art in assembling panels which are substantially perpendicular to one another.

SUMMARY

According to an embodiment, there is provided a clip for securing a tight connection between two modular panels. The connection comprising a male portion on a first one of the two modular panels and a female portion on a second one of the two modular panels. The male portion for insertion into the female portion upon assembly of the two modular panels. The clip comprises: a first flat member having a first pressure edge; and a second flat member fixedly joined to the first flat member. Once the panels are assembled in an assembly direction and upon introduction of the first flat member into either one of the male portion and the female portion and of the second flat member into the other one of the male portion and the female portion, the introduction being perpendicularly to the assembly direction, the first pressure edge of the first flat member forces the male portion toward the female portion thereby securing the tight connection between the two modular panels.

Further in accordance with the above embodiment, there is optionally provided a second pressure edge for forcing the male portion toward the female portion upon assembly of the two modular panels.

Further in accordance with the above embodiment, there is optionally provided a third flat member and a fourth flat member respectively aligned with the first and the second flat members to prevent twisting of the clip in the assembly direction upon assembly of the two modular panels.

According to another aspect of the invention, there is provided a fastening guide for use with the clip described above. The fastening guide comprises a central member forming an angle with a guiding member. The central member for being placed in alignment with an edge of the third modular panel. The guiding member for guiding a user in aligning the fastening means through the third modular panel.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION

Figure 1:
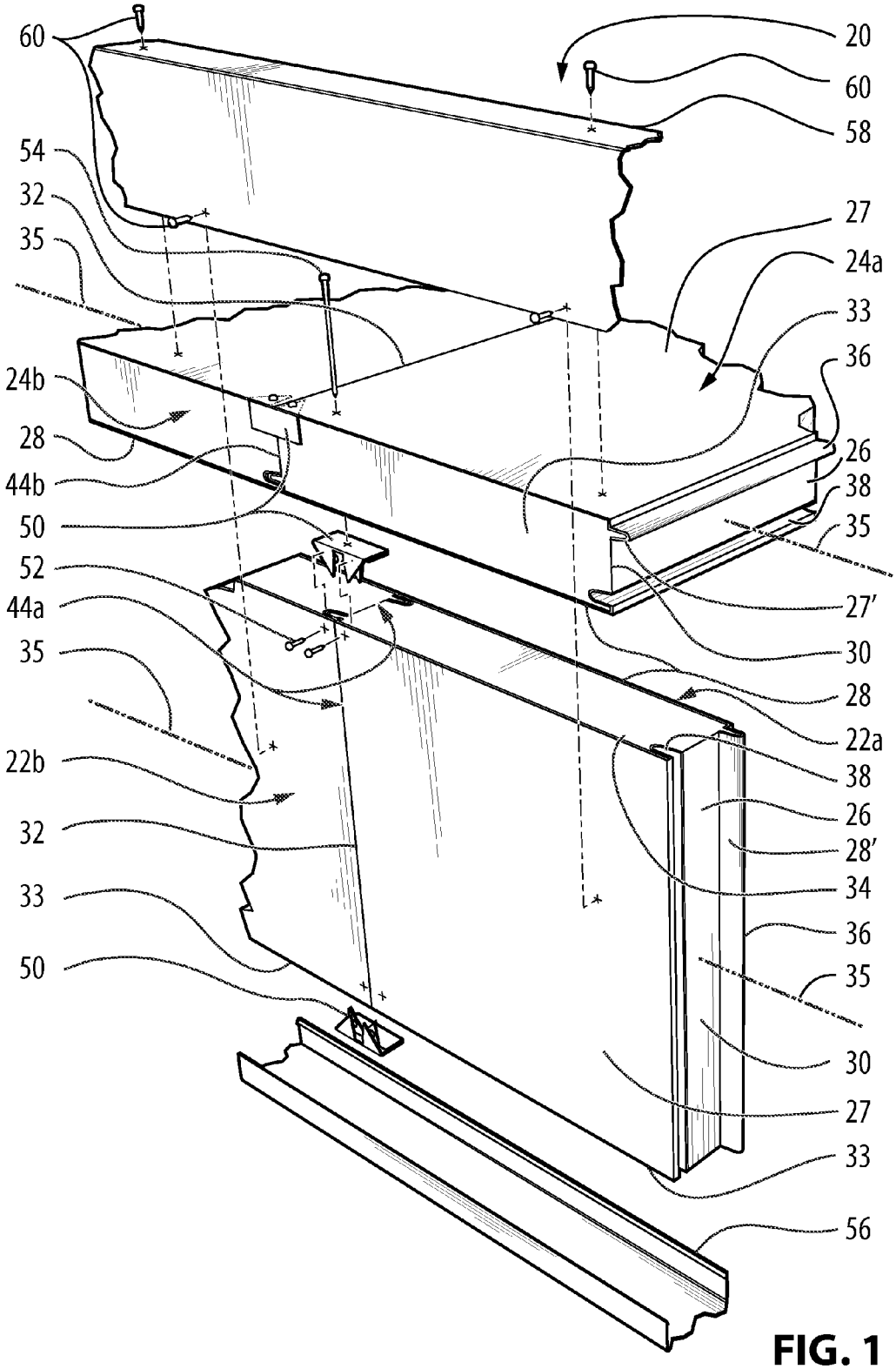
FIG. 1 is a perspective, partially exploded view of an assembly of two wall panels with two perpendicular ceiling panels and finishing moldings in accordance with an embodiment.

Referring now to the drawings, and more particularly to FIG. 1, there is illustrated an assembly 20 of two wall panels 22*a* and 22*b* with two perpendicular ceiling panels 24*a* and 24*b* in accordance with an embodiment.

The wall panels 22*a* and 22*b* and the ceiling panels 24*a* and 24*b* are each made of a foam material 26 enclosed between two exterior sheets of material 27 and 28 which are made of any sheet material such as any kind of steel or aluminum. In accordance with one fabrication process, the foam material 26 is injected between the two exterior sheets of material 27 and 28 and let to harden, thereby forming a solid modular panel. The foam material 26 can be any type of insulating material such as Injected Polyurethane Foam (IPF) or any other laminated insulating material such as mineral wool or polyurethane.

Each one of the sheets 27 and 28 extends from one pair of opposite edges 30 and 32 to another pair of perpendicular opposite edges 33 and 34 of each panel. For description purposes, sheet 27 forms exterior sides of the panels in the assembly 20, while sheet 28 forms interior sides. Each of the sheets 27 and 28 has an exterior surface which lies in a plane substantially parallel to a direction of assembly 35 made by two (or more) modular panels assembled side by side to define a wall or a ceiling; i.e., 22*a* with 22*b*, and 24*a* with 24*b*.

The panels 22*a*, 22*b*, 24*a* and 24*b* each have a male portion 36 and a female portion 38 extending longitudinally along each one of the pairs of opposite edges 30 and 32. The male portion 36 extends closest to an exterior surface or near a first one of the two sheets 27 or 28, while the female portion 38 extends closest to another opposite exterior surface or near a second one of the two sheets 27 or 28.

The male portion 36 forms a tongue (also referred to as a tenon) which is made to be inserted into a groove (also referred to as a mortise) formed by the female portion 38 to create a connection, 44*a* or 44*b*, with a neighboring modular panel extending along the same assembly direction 35. In FIG. 1 for example, panel 22*a* and panel 22*b* each have opposite male and female portions 36 and 38 at the connection 44*a*. These are not shown since they are inserted into one another to form the connection 44*a*. The same applies for panels 24*a* and 24*b*. Both the tongue and the groove can take variable shapes provided they form an interference fit upon assembly in direction 35.

The male and female portions 36 and 38 are each strengthened by an extension 27' or 28' of the closest one of the two sheets 27 or 28. These extensions 27' and 28' extend within or around either one of the groove or tongue made by the female portion 38 or the male portion 36. Of course, other embodiments for the male and female portions 36 and 38 are possible and are considered to fall within the scope of the present invention.

Still referring to FIG. 1, the assembly 20 is secured by way of clips 50 inserted upon assembly of the panels 22*a* with 22*b* and 24*a* with 24*b*, at the connections 44*a* and 44*b*. The clips 50 are inserted in the foam material 26 of either one of the pair of opposite edges 33 and 34, or in both opposite edges 33 and 34, of each panel forming a connection 44*a* and 44*b* (i.e., panels 22*a* and 22*b* or panels 24*a* and 24*b*). Upon assembly, the clips 50 are also secured to each one of the panels forming the connections 44*a* and 44*b* using fastening means such as screws or nails 52.

A second fastening means, such as a long screw or nail 54, secures panels 24*a* perpendicularly to the connection 44*a* made by panels 22*a* and 22*b*. The long screw 54 passes through the panel 24*a* until it is received in the clip 50. Since long screw 54 is not used for the clip 50 which holds panels 24*a* and 24*b* (i.e., ceiling panels) together, fastening means 52 are optional. The structure and features of the clip 50 is further detailed herein below.

The assembly 20 is completed by covering the bottom edges 33 of the wall panels 22*a* and 22*b* with a floor molding 56. The edges 33 of the panels 24*a* and 24*b* once assembled with the wall panels 22*a* and 22*b* are also finished with a covering cap 58 secured thereto using fastening means such as screws or nails 60. The floor molding 56 and the cap 58 are optional features and may take various shaped as desired.

Figure 2A:
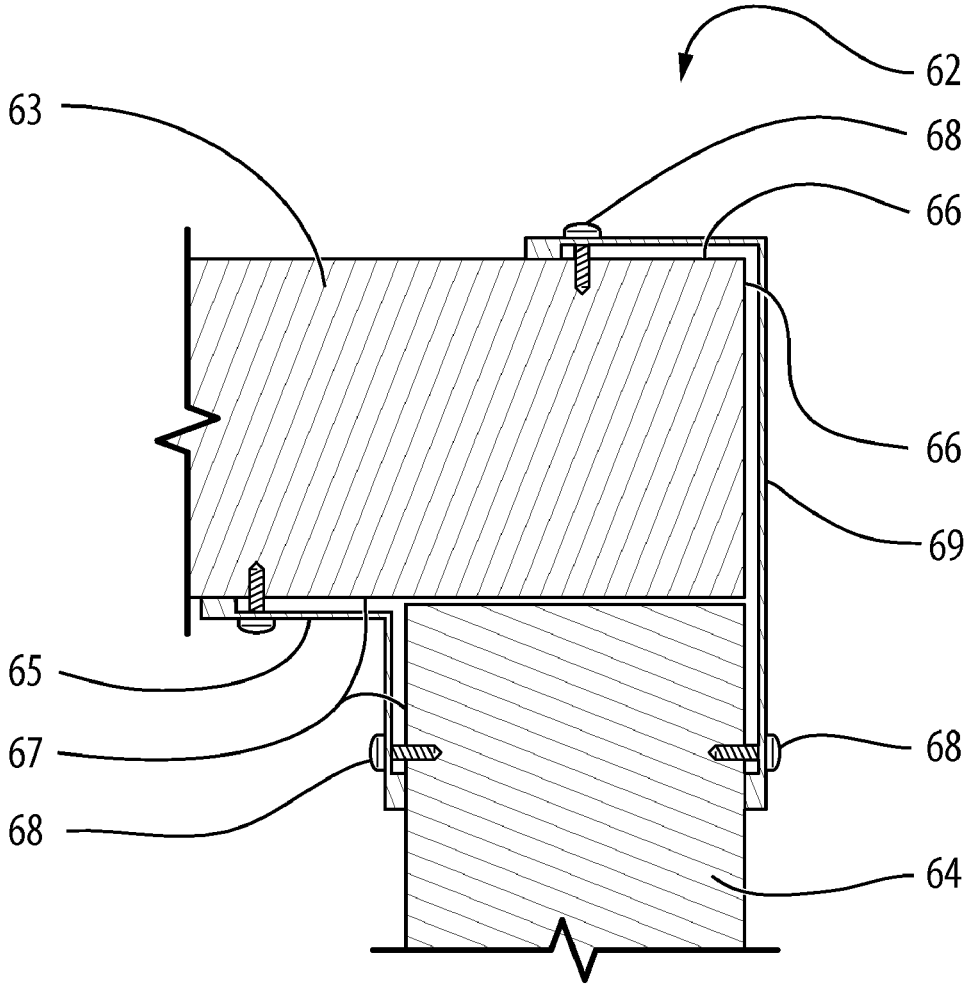
FIG. 2a PRIOR ART
FIG. 2*a* is a cross-sectional view of an assembly of a wall panel to ceiling or floor panel in accordance with the prior art.
Figure 2B:
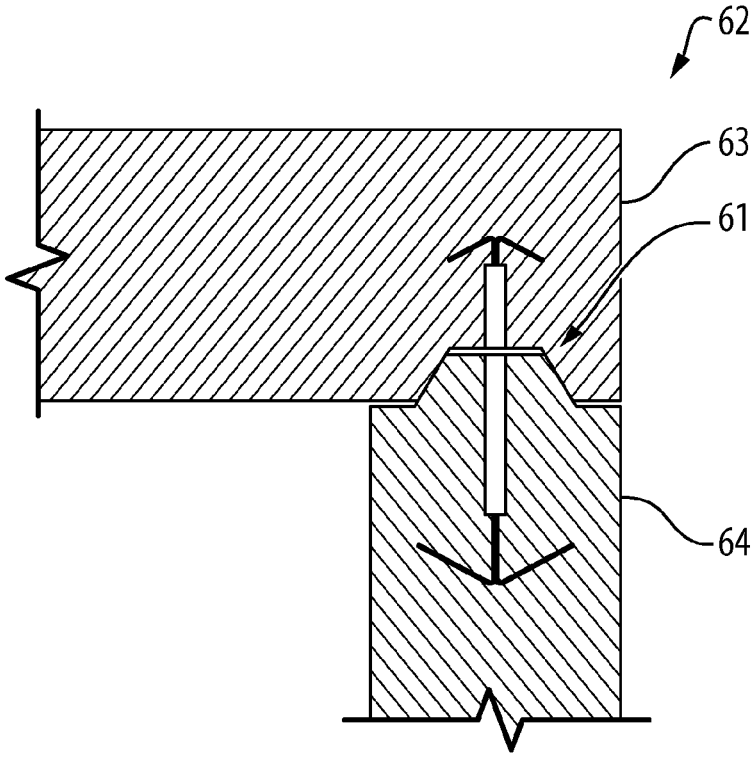
PRIOR ART FIG. 2b
FIG. 2*b* is another cross-sectional view of an assembly of a wall panel to ceiling or floor panel in accordance with the prior art.
Figure 2C:
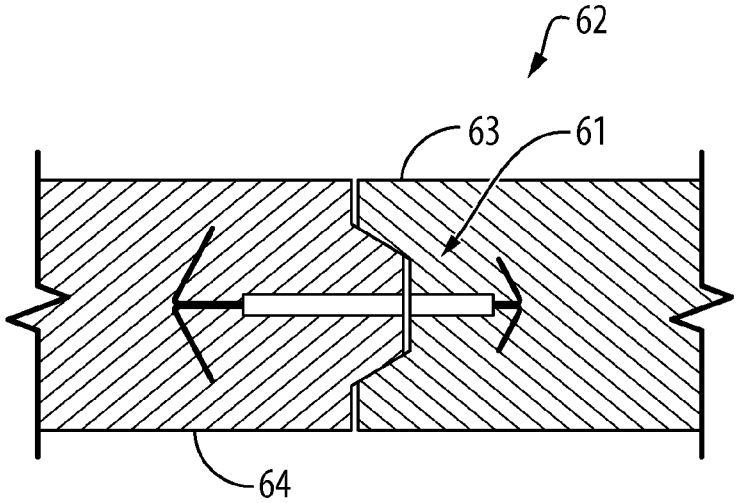
PRIOR ART FIG. 2c
FIG. 2*c* is a cross-sectional view of an assembly of an end-to-end wall arrangement in accordance with the prior art.

The assembly 20 illustrated in FIG. 1 can be contrasted to the prior art assembly 62 illustrated in FIGS. 2*a*, 2*b* and 2*c*.

In the prior art of FIG. 2*a*, two modular panels 63 and 64 are assembled perpendicularly to one another by way of a trim 65 secured on the inner edge 67 formed by the junction of the panels 63 and 64 using fastening means such as screws 68. Trim 69 is installed around outer edge 66 for finishing purposes. This arrangement does not provide a tight fit between the panels. In the prior art of FIGS. 2*b* and 2*c*, there is shown 63 and 64 assembled using a cam lock fastener 61. FIG. 2*b* shows a perpendicular wall arrangement while FIG. 2*c* shows an end-to-end wall arrangement. The cam lock themselves are expensive and their installation in the panels fabrication requires manipulation which could otherwise be avoided.

Unlike with the prior art, the assembly 20 provided by FIG. 1 can be performed and secured without the need of the metal sheets 65. In the prior art, the presence of joining elements such as the metal sheet 65 on the inner edge 67 generally requires that finishing trim be installed there over for fastening purposes. In the assembly 20 of FIG. 1, finishing trims are optional. In fact, in the assembly of FIG. 1, an inside wall/ceiling trim such as trim 65 of FIG. 2*a* is not required thereby offering a cleaner look, less joints and a strong junction.

Now referring to FIGS. 3*a*, 3*b*, 4*a*, 4*b* and 5*a*, 5*b*, 5*c* and 5*d*, there is shown an embodiment of the clip 50 of FIG. 1.

Figure 3A:
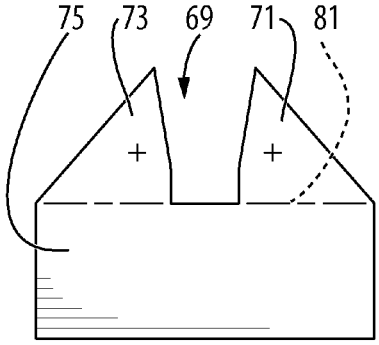
FIG. 3*a* is a top unfolded plan view of a first piece of material for forming a clip in accordance with an embodiment.
Figure 3B:
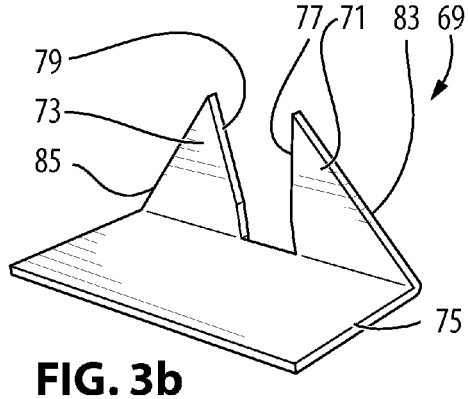
FIG. 3*b* is a perspective view of the first piece of material of FIG. 3*a*, once folded.

Referring to FIGS. 3*a* and 3*b*, the clip 50 is made by die-cutting a first piece of metal 69 as shown in FIG. 3*a*. The piece of metal 69 is folded at a substantially right angle along folding line 81 to form a first flat member 71, a third flat member 73, and a top plate 75.

Figure 4A:
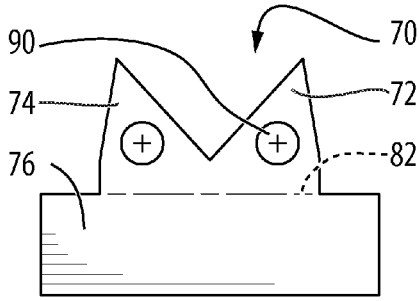
FIG. 4*a* is a top unfolded plan view of a second piece of material for forming a clip in accordance with an embodiment.
Figure 4B:
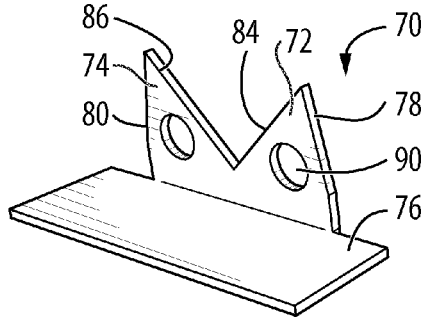
FIG. 4*b* is a perspective view of the second piece of material of FIG. 4*a*, once folded.

Referring to FIGS. 4*a* and 4*b*, a second piece of metal 70 is similarly die-cut and folded along folding line 82 to form a second and a fourth flat member 72 and 74 as well as a bottom plate 76.

Figure 5C:
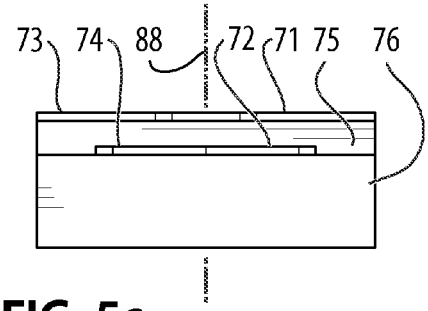
FIG. 5*c* is a top plan view of the clip of FIG. 5*a;*
Figure 5A:
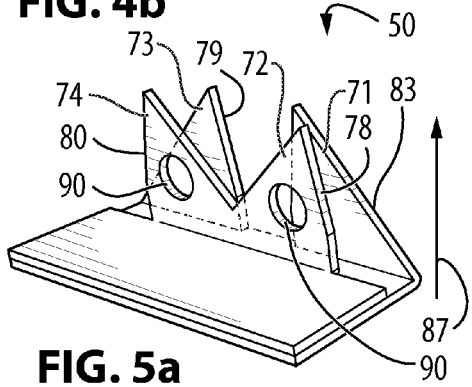
FIG. 5*a* is a perspective view of a clip in accordance with an embodiment.

As seen in FIG. 5*a*, the lower surface of the bottom plate 76 of the second piece of metal 70 and the upper surface of the top plate 75 of the first piece of metal 69 are joined together and welded or riveted to form the clip 50. The top plate 75 joins the first, second, third and fourth flat member, 71 to 74 respectively, of the clip 50.

The flat members 71 to 74 each have a pressure edge, 77 to 80 respectively, which is angled in shape.

In this embodiment, the edges 83 to 86 opposite with respect to the pressure edges 77 to 80 are also angled. The junction of both edges 77 to 80 with respective edges 83 to 86 form a tip which eases the insertion of the clip 50 into a modular panel's foam material, in an insertion direction 87 which is intended to be perpendicular to the assembly direction 35 as seen in FIG. 1. Once the clip is inserted, the top plate 75 remains exterior to the panel.

Figure 5D:
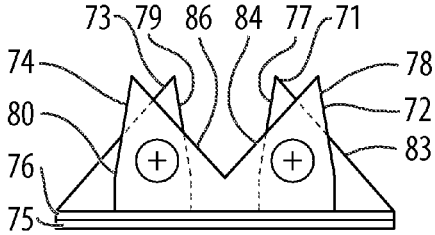
FIG. 5*d* is a front elevation view of the clip of FIG. 5*a;*
Figure 5B:
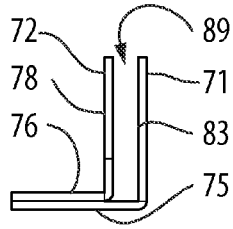
FIG. 5*b* is a side elevation view of the clip of FIG. 5*a;*

The clip 50 has a gap 89 provided by the fact that the top plate 75 is wider than the bottom plate 76, to separate the first and second flat members 71 and 72, and the third and fourth flat members 73 and 74 by a given distance, as seen in FIG. 5*b*. The given distance of the gap 89 is intended to be approximately equivalent to about a maximal distance between the male portion 36 on a first modular panel and the female portion 38 on a second modular panel, once inserted into each other upon the panels being assembled along the assembly direction 35 (refer to FIG. 1).

As seen in FIG. 5*c*, the third flat member 73 and the fourth flat member 74 are respectively aligned with the first and the second flat members 71 and 72. The third and fourth flat members 73 and 74 also form a mirror image of the first and second flat members 71 and 72 with respect to an axis 88 perpendicular to the insertion direction and passing in the middle of the clip 50. This therefore makes the clip 50 entirely reversible.

Referring more particularly to FIGS. 5*a* and 5*d*, each one of the second and fourth flat members 72 and 74 has an opening 90 to let through a screw or a nail (not shown). The screw or the nail (not shown) pierces through the first and third flat members 71 and 73 to arrive substantially perpendicularly to the second and fourth flat members 72 and 74.

Several modifications of the clip 50 as described above are possible. For example, in reference to FIG. 5*a*, the third and fourth flat members 73 and 74 can be removed, leaving the first and second flat members 71 and 72. However, stability when inserting clip 50 is not as good in this case.

The clip 50 can substantially form a U-shaped body defining co-planar parts joined together via a connecting part. Though this alternative is not illustrated, the body of the clip 50 can be conceptualized by taking the first and the second flat members 71 and 72 as comprising one of the co-planar parts of the U-shaped body. The top plate 75 then forms the connecting part and joins the first and the second co-planar parts.

In addition, the second flat member 72 may also have any type of edge in place of the pressure edge 78 (refer to FIG. 5*a*). In this case, only one of the flat members, such as flat member 71, has the pressure edge 77 and performs the forcing of the male portion 36 of a first panel into the female portion 38 of a second panel upon assembly in the direction of assembly 35 (refer to FIG. 1).

Any one of the pressure edges 77 to 80 can be curved, as long as one of the pressure edges 77 to 80 provides a force towards a joining male or female portion of two modular panels upon assembly. Note that upon insertion of clip 50, the pressure edges 77 to 80 provide a similar effect as the cam in the cam-lock fastener of the prior art.

In addition, the opposite edges 83 to 86 of each one of the flat members 71 to 74 can be shaped in any differing fashion, although a sharp angle such as illustrated in FIGS. 3*a* to 5*d* enables facilitated insertion of the clip 50 into the panels in the insertion direction 87.

Figure 6A:
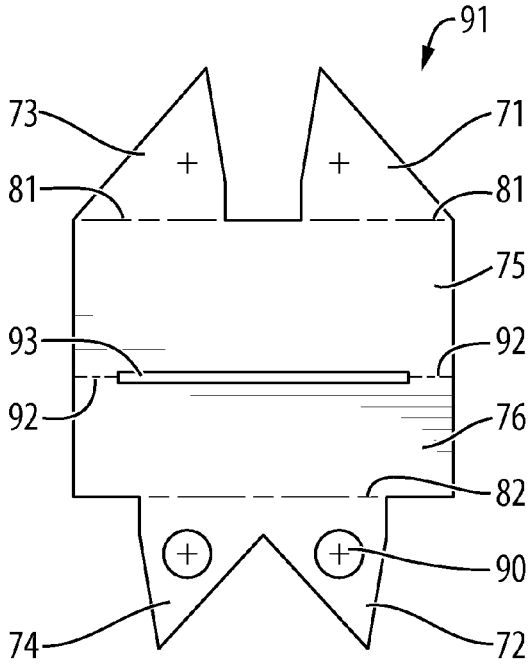
FIG. 6*a* is a top unfolded plan view of a clip in accordance with another embodiment.

Another variation of the clip 50 as previously described is illustrated in FIGS. 6*a* to 6*e*. According to this embodiment, the first and second pieces of metal (69 and 70 in FIGS. 3*a* to 4*b*) are replaced by a unitary single piece of material 91 having the four flat members 71 to 74 at opposite ends of the piece 91 as seen in FIG. 6*a*.

In this embodiment, the clip 50 is fabricated by die-cutting the single piece of material 91. The four flat members 71 to 74 are then folded. The flat members 71 and 73 are folded along folding line 81, at an angle opposite a folding angle of the flat members 72 and 74 along the folding line 82. The plane formed by the flat members 71 and 73 is kept substantially parallel to a plane formed by the flat members 72 and 74.

The single piece 91 is once again folded over itself along a folding line 92 located substantially at a center region thereof. An opening 93 is practiced along the folding line 92 of the single piece of metal 91 to ease the folding.

Figure 6B:
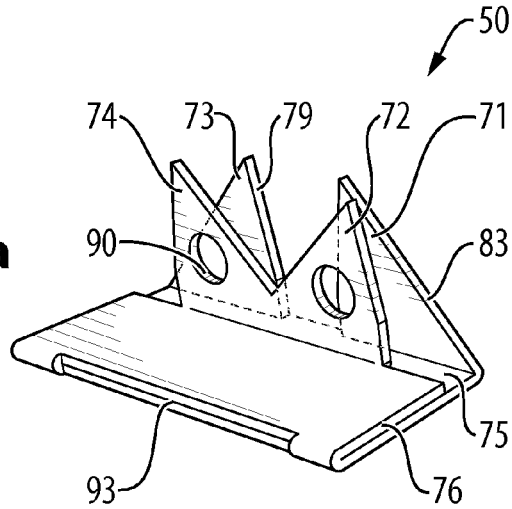
FIG. 6*b* is a perspective view of the clip of FIG. 6*a*, once folded.

This final folding forms the clip 50 of FIG. 6*b*. The top plate 75 linking the first and the second flat members 71 and 72, and the third and the fourth flat members 73 and 74 is unitary with the bottom plate 76.

Figure 6C:
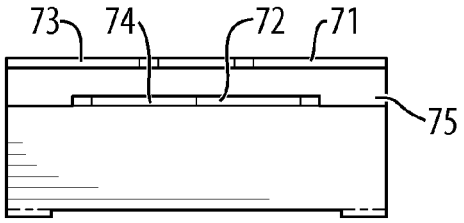
FIG. 6*c* is a top plan view of the clip of FIG. 6*b;*
Figure 6D:
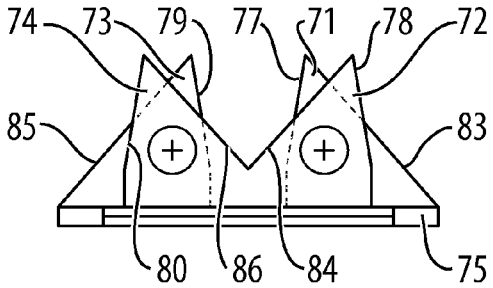
FIG. 6*d* is a front elevation view of the clip of FIG. 6*b;*
Figure 6E:
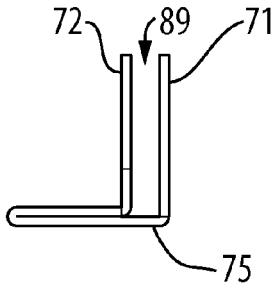
FIG. 6*e* is a side elevation view of the clip of FIG. 6*b;*

FIG. 6*c* to 6*e* each respectively illustrate a top, front and side elevation view of the clip 50 as illustrated in FIG. 6*b*.

It is noted that in FIGS. 6*a* to 6*e*, the opening 93 is optional, but facilitates the folding.

Figure 7:
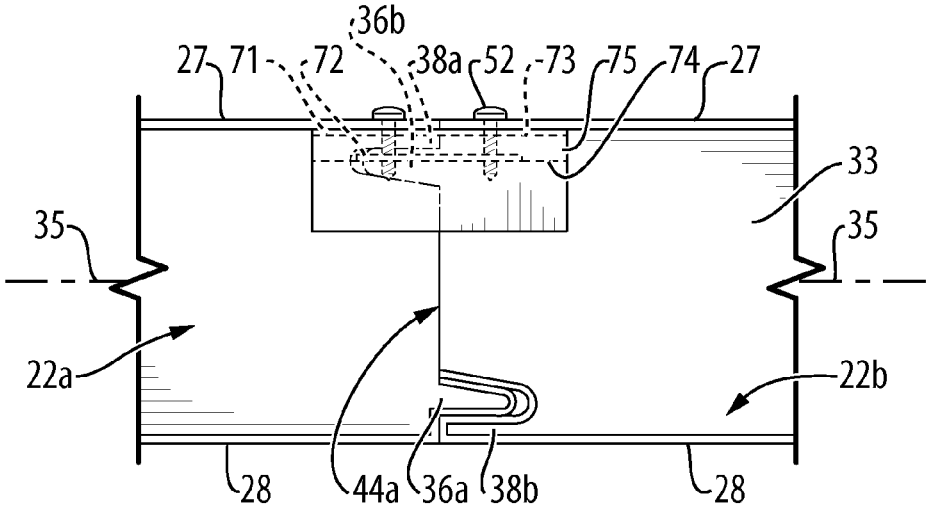
FIG. 7 is a top plan view of two modular panels secured together with the clip of FIG. 5*a* in accordance with an embodiment.

Now referring to FIG. 7, once the panels 22*a* and 22*b* are assembled in the assembly direction 35, the female portion 38*a* of the panel 22*a* receives the male portion 36*b* of the other panel 22*b* and the male portion 36*a* of the panel 22*a* inserts in the female portion 38*b* of the panel 22*b*. The clip 50 is inserted partly into panel 22*a* and partly into panel 22*b*, the top plate 75 remaining over the edge 33 of the panels. Again note that other embodiments for the male and female portions 36 and 38 are possible and are considered to fall within the scope of the present invention (e.g., the two male portions could be on the one side of a junction while the two female portions would be on the other side of the junction).

More specifically, the first flat member 71 is introduced into the female portion 38*a* of the panel 22*a*, and the second flat member 72 is introduced into the male portion 36*b* of the panel 22*b*, along the insertion direction perpendicular to the assembly direction 35. In this way, the first pressure edge 77 (refer to FIG. 5*d* or 6*d*) of the first flat member 71 forces the female portion 38*a* toward the male portion 36*b*, while the second pressure edge 78 of the second flat member 72 forces the male portion 36*b* toward the female portion 38*a*, thereby securing and tightening the connection 44*a* between the two modular panels 22*a* and 22*b*. The third and fourth flat members 73 and 74 are both inserted into the panel 22*b*, beside the male portion 36*b*. The clip 50 is finally secured to both panels 22*a* and 22*b* using the screws or nails 52.

The reversible structure of the clip 50 provides a stability mechanism in the assembly direction (35 in FIG. 1) upon assembly of two modular panels. When the first and second flat members 71 and 72 are inserted into the female portion 38*a* and the male portion 36*b* as illustrated, the third member 73 provides the stability by securing into the panel 22*b*. The third flat member 73 prevents the clip from twisting as it abuts against sheet 27. The third flat member 73 is also used to fasten to panel 22*b* by using fastening means 52. The third and fourth flat members 73 and 74 do not perform the actual junction between the male and female portions of each panel.

The mirror structure of the clip 50 also allows the clip 50 to be inserted along either one of the exterior sheets 27 or 28 of the panels 22*a* and 22*b*. For example, although the clip 50 is illustrated in FIG. 7 as being inserted closest to sheets 27, it may be inserted on the opposite side, closest to sheets 28. In such a case, the above description is reversed. According to another embodiment, clips 50 are inserted on both sides of the modular panel.

Still referring to FIG. 7, in the reversed case, the third and fourth flat members 73 and 74 are inserted in one of the female portion 38*b* and the male portion 36*a*. The first and second members 71 and 72 provide the stability mechanism by both being inserted in the panel 22*a*. In this configuration, the first and second flat members 71 and 72 do not perform the actual junction between the male and female portions 36*a* and 38*b* of each panel. According to another embodiment, clip 50 can be inserted near sheet 27 (or sheet 28), but not at a junction. This can be useful in the assembly of panels perpendicularly.

Figure 8:
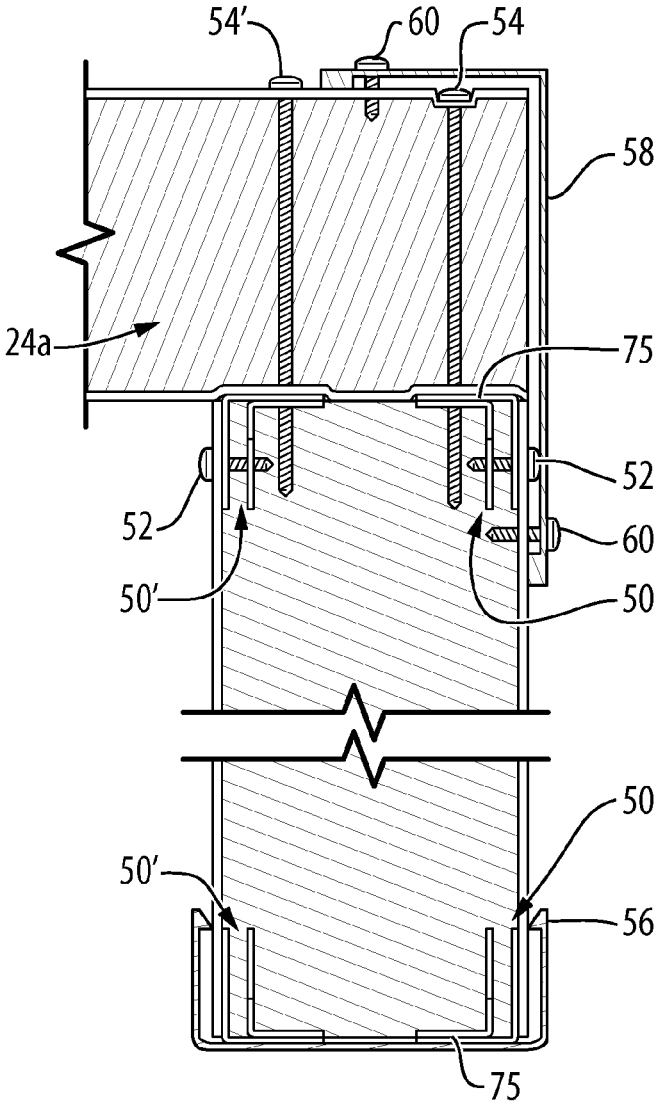
FIG. 8 is a cross-sectional view of an assembly of two wall panels with a perpendicular ceiling panel, taken across a connection between the two wall panels, in accordance with an embodiment.

FIG. 8 shows a cross-sectional view of an assembly of a third perpendicular ceiling panel 24*a* with a connection between wall panels 22*a* and 22*b*, taken across the connection (44*a* in FIG. 1). The long screw 54 is inserted through the third perpendicular ceiling panel 24*a* and secures into the top plate 75 of the clip 50. Experience has shown that it is useful to tighten screw 54 sufficiently to compress the foam between the wall panels. Similarly, long screw 54' opposite the long screw 54 is inserted through the third perpendicular ceiling panel 24*a* and secures into the top plate 75' of the clip 50' opposite the clip 50. It is understood that while FIG. 8 shows a wall/ceiling junction, the same description would be applicable to a wall-to-wall perpendicular junction.

It is noted that in FIG. 8, another pair of clips 50 and 50' are placed at the bottom of the wall panels 22*a* and 22*b*. In other embodiment, clips at the bottom of the wall panels 22*a* and 22*b* are not required.

It should also be noted that while both clips 50 and 50' are shown to be installed on FIG. 8, only one of them would be necessary; i.e., an exterior installation or interior installation.

Now referring to FIGS. 9*a* to 9*d*, there is described a fastening guide 100 in accordance with an embodiment.

The fastening guide 100 has two guiding members 102 and 104 distanced by a central member 106 which is of a length that is substantially equal to the thickness of a panel such that the fastening guide 100 can be placed over an edge forming a connection between two modular panels, such as connections 44*a* and 44*b* in FIG. 1.

The first guiding member 102 has a number of indentations 108, here three; indentations 108*a*, 108*b* and 108*c*. Two of these indentations, 108*a* and 108*c*, are for guiding the alignment of two fastening means (not shown) which are used to secure the clip 50 to the two modular panels 22*a* and 22*b*; such as screws or nails 52 in FIG. 1 and thereby go through opening 90.

The third indentation 108*b* is used to provide adequate clearance for a third fastening means (not shown). This third fastening means is used to secure the third perpendicular modular panel 24*a* to the two modular panels 22*a* and 22*b* via the clip 50; such as long screws 54 or 54' of FIG. 8.

Still referring to FIGS. 9*a* to 9*d*, the second guiding member 104 has an elongated opening 110 extending from an end 112 of the fastening guide 100 toward the central member 106.

The elongated opening 110 acts as a guide, in conjunction with the middle one of the indentations 108*b*, for aligning the third fastening means (not shown), through the third perpendicular modular panel 24*a* until it reaches the clip 50 which joins the two modular panels 22*a* and 22*b* together. The elongated opening 110 permits removal of the guide 100 once the third fastening means is inserted. The elongated opening 110 has two markings 116 and rounded portion 115 for guiding the alignment of the long screws 54' and 54 respectively, as seen in FIG. 8. These are further described below.

Figure 9C:
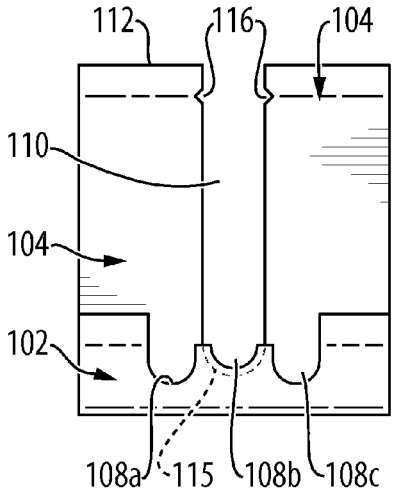
FIG. 9*c* is a top elevation view of the fastening guide of FIG. 9*a;*
Figure 9A:
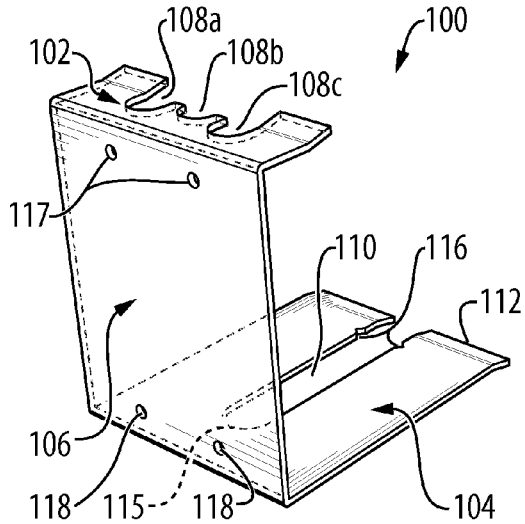
FIG. 9*a* is a perspective view of a fastening guide in accordance with an embodiment.
Figure 9D:
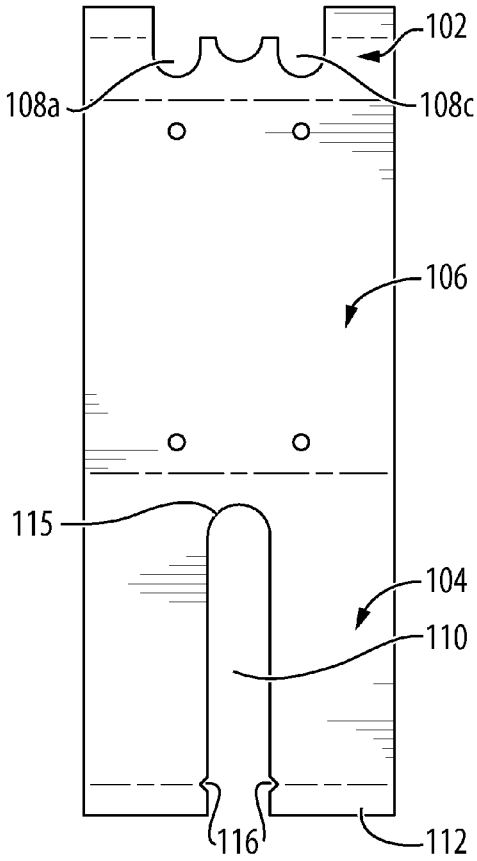
FIG. 9*d* is an unfolded top plan view of the fastening guide of FIG. 9*a;*
Figure 9B:
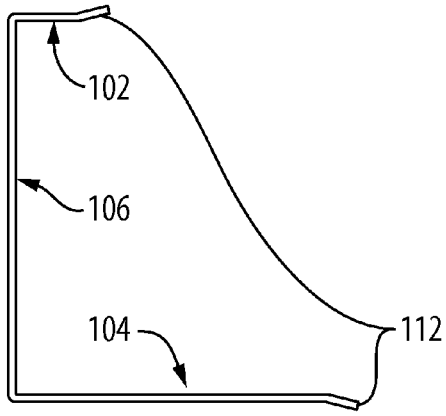
FIG. 9*b* is a side elevation view of the fastening guide of FIG. 9*a;*

Referring more particularly to FIG. 9*d*, the fastening guide 100 is made of a single piece of material which is folded to form the two guiding members 102 and 104. The fastening guide 100 has a shape permitting to enclose an entire edge (33 or 34 in FIG. 1) of a modular panel, as illustrated in FIGS. 10 and 11.

Figure 10:
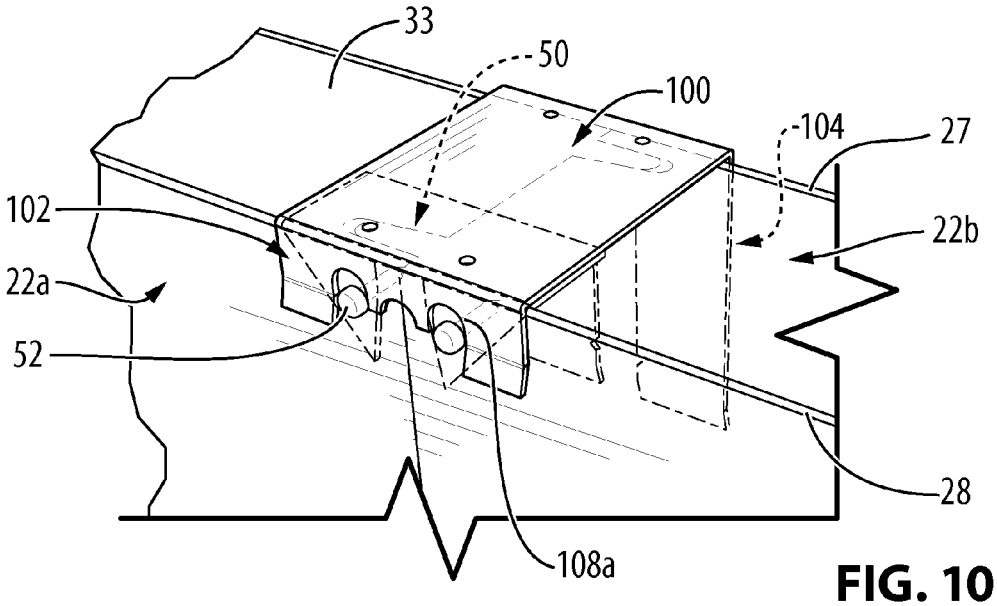
FIG. 10 is a perspective view of the fastening guide of FIG. 9*a* in use with the clip of FIG. 5*a* or FIG. 6*b* for assembling two modular panels in accordance with an embodiment.

Referring to FIG. 10, the fastening guide 100 is first used with the clip 50 in aligning the screws 52 to secure the clip 50 into each one of the two modular panels 22*a* and 22*b*. In this case, the fastening guide is placed over the clip 50 and encloses the edge 33 (or 34) of each one of the modular panels 22*a* and 22*b*. The indentations 108*a* and 108*c* are used to align the screws 52 into each one of the panels 22*a*, 22*b* and clip 50. Hence, screws 52 are aligned in holes 90. Without holes 90, the clip 50 would deform and cause delaminating of the panel. According to an embodiment, guide 100 is the same width as the clip 50 thereby facilitating alignment thereof.

Figure 11:
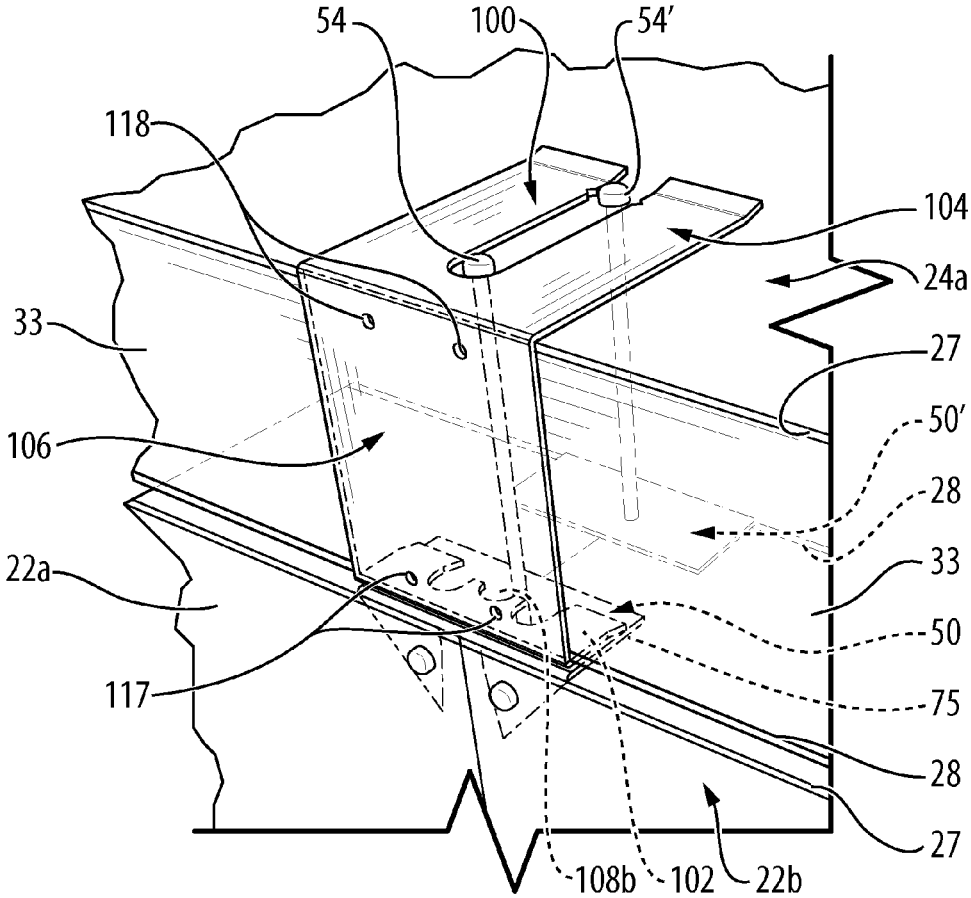
FIG. 11 is a perspective view of the fastening guide of FIG. 9*a* in use with the clip of FIG. 5*a* or FIG. 6*b* for assembling two modular panels with a perpendicular ceiling panel using a fastening screw in accordance with an embodiment.

As seen in FIG. 11, the marking 115 of the fastening guide 100 can also be used with the clip 50 in aligning the long screw 54 through the third modular panel 24*a* (or 24*b*) for insertion into the top plate 75 of the clip 50. In this case, the fastening guide 100 is placed over the edge 33 of the third modular panel 24*a*, with the first guiding member 102 being aligned equally with the top plate 75 of the clip 50 or by aligning holes 117 with screws 52 or by placing them at equal distance on either side of the joint between the panels. Holes 118 for their part would be used when guide 100 is used on top of a ceiling panel in a reverse fashion (i.e., with guiding member 104 on panel 24*a* and guiding member 102 above and away from panel 24*a*). The marking 116 of the fastening guide 100 is similarly used to align screw 54' into clip 50' located opposite to the clip 50.

Although not illustrated in FIG. 11, the fastening guide 100 can be placed differently than illustrated to guide a user in aligning the long screw 54 for securing with the clip 50. For example, in a first case, the first guiding member 102 is placed on top of the sheet 27 of the third panel 24*a*, abutting on the edge 33 of that panel 24*a*. In this position, the central member 106 is aligned with either one of the sheets 27 and 28 of each one of the panels 22*a* and 22*b*.

In an alternative second case, the second guiding member 104 is placed on top of the sheets 27 of the third panel 24*a*, abutting on the edge 33 of that panel 24*a*. The central member 106 is aligned with either one of the sheets 27 or 28 of the panels 22*a* and 22*b*, opposite from the location of the clip 50 or 50' to which it is intended to be fastened.

The first marking 115 of the elongated opening 110 is used for aligning the long screw 54 for attachment with the clip 50 when the first guiding member 102 is placed in contact with the top plate 75 of the clip 50, or whenever the central member 106 is aligned with the exterior sheet 27 of the panels 22*a* and 22*b* closest to the clip 50.

The second marking 116 of the elongated opening 110 is used for aligning the long screw 54' for attachment with the clip 50 when the central member 106 is in alignment with the exterior sheet 27 of the panels 22*a* and 22*b* which is opposite from the location of the clip 50, as also illustrated in FIG. 8 and FIG. 10.

Guide 100 further includes lips 112 to facilitate insertion of guide 100 and to avoid or prevent scratching or marking of the panels. It should also be noted that the U shape of the guide 100 helps in preventing delaminating of panels while inserting screw 54.

Alternative embodiments of the fastening guide 100 are considered. For example, the fastening guide 100 may be formed by multiple pieces of material instead of a single one as described hereinabove.

Figure 12:
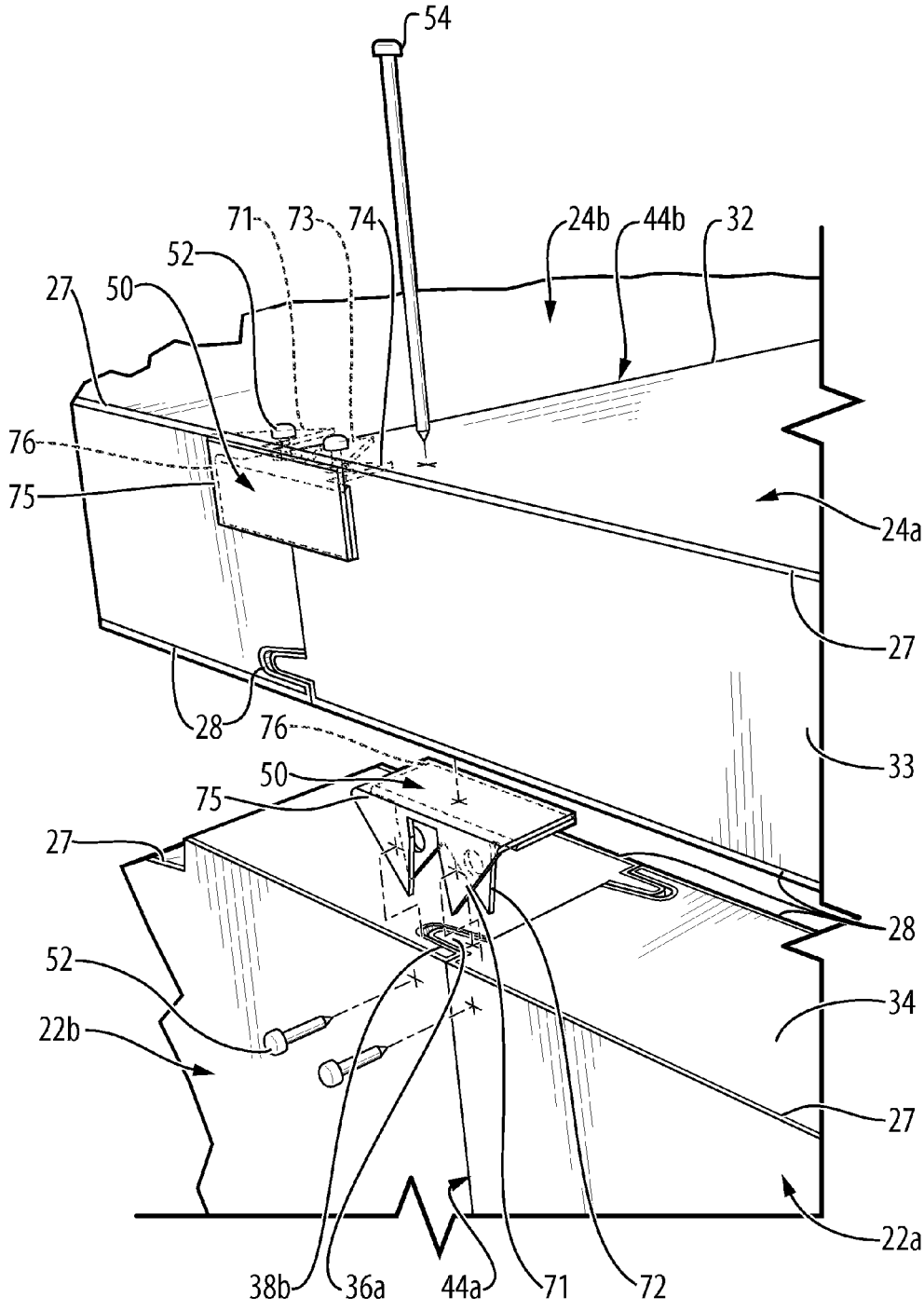
FIG. 12 is a close-up view detailing the assembly of the two wall panels with the two ceiling panels of FIG. 1.

FIG. 12 shows the assembly 20 of FIG. 1, more specifically where the two wall panels 22*a* and 22*b* meet with the two ceiling panels 24*a* and 24*b*.

Figure 13:
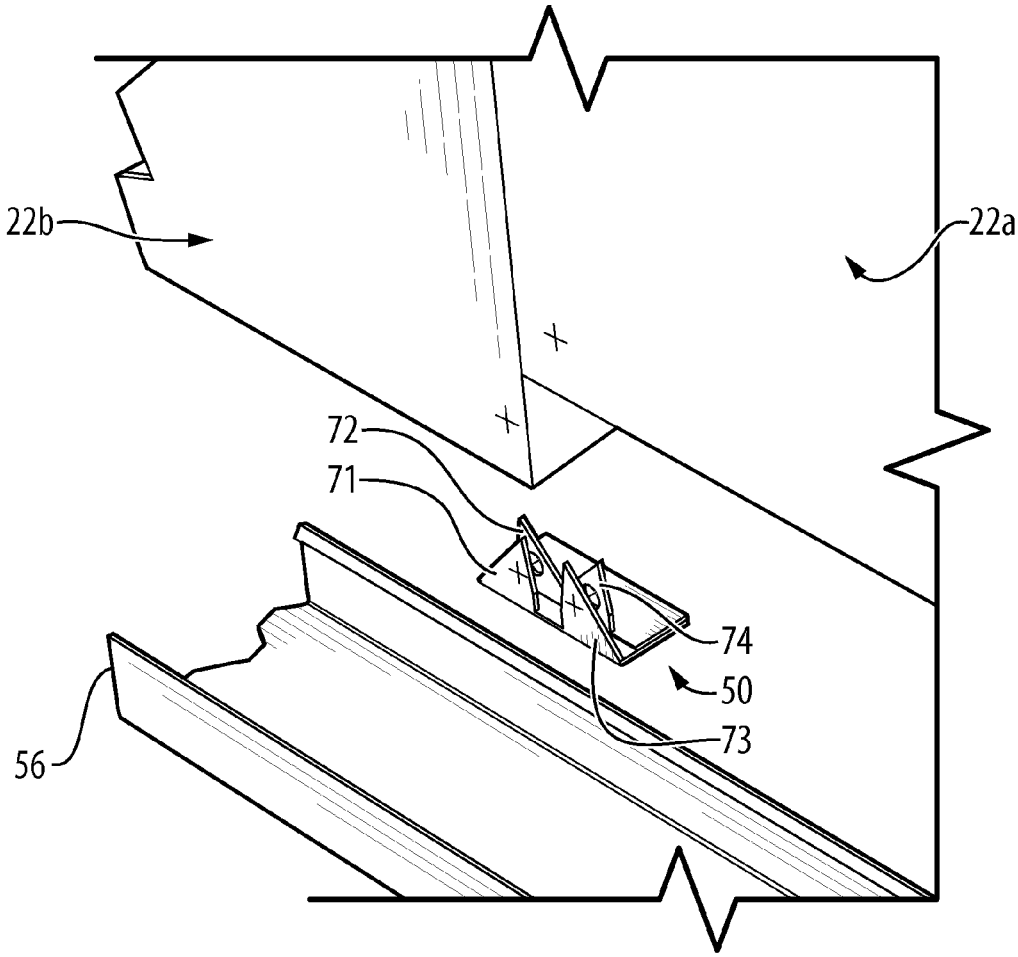
FIG. 13 is a close-up view detailing the assembly of the two wall panels with one of the finishing moldings.

FIG. 13 shows the assembly 20 of FIG. 1, more specifically where the two wall panels 22*a* and 22*b* meet with a bottom finishing molding 56 used at the floor of a walk-in unit. Such a molding is optional and can be further secured to the wall panels using tightening screws or adhesives (not shown) for example. The assembly 20 of FIG. 13 is performed according to the following steps. First, a clip 50 is inserted in the bottom of panel 22*b* as shown in FIG. 13. Then, panel 22*b* is set down in molding 56. Finally, panel 22*a* is slid onto clip 50 and into molding 56 so that the panels 22*a* and 22*b* are forced toward each other.

While preferred embodiments of the invention have been described above and illustrated in the accompanying drawings, it will be evident to those skilled in the art that modifications may be made therein without departing from the essence of this invention. Such modifications are considered as possible variants comprised in the scope of the invention.

The invention claimed is:

1. A clip for securing a tight connection between two modular panels, the connection comprising a male portion on a first one of the two modular panels and a female portion on a second one of the two modular panels, the male portion for insertion into the female portion upon assembly of the two modular panels, the clip comprising:

a first flat member having a first pressure edge and a first leg extending substantially perpendicular from a first lower edge thereof;

a second flat member having a second leg extending substantially perpendicular from a second lower edge thereof; one of said first leg or said second leg being placed atop the other of said first leg or second leg in an adjoining relationship; and a top plate joining the first flat member to the second flat member;

once the panels are assembled in an assembly direction and upon introduction of the first flat member into either one of the male portion and the female portion and of the second flat member into the other one of the male portion and the female portion, the introduction being perpendicularly to the assembly direction, the first pressure edge of the first flat member forces the male portion toward the female portion thereby securing the tight connection between the two modular panels;

wherein the first and second flat members form a U-shaped body having two respective parallel planar parts, the distal ends of the legs terminate outside said U-shape, wherein at least a portion of one of the legs forms a portion of the U-shaped body.

2. The clip as in claim 1, wherein the second flat member comprises a second pressure edge for forcing the male portion toward the female portion upon assembly of the two modular panels.

3. The clip as in claim 2, wherein each one of the two modular panels comprises a foam layer partially enclosed by two exterior sheets of material each in a plane substantially parallel to the assembly direction, the male portion and the female portion each being formed in the foam layer, near one of the two exterior sheets of material, and each one of the male portion and the female portion comprising an extension of one of the two exterior sheets of material, wherein each one of the first and second pressure edges exert a force against a respective extension.

4. The clip as in claim 2, wherein at least one of the first and second flat members is adapted to receive a fastening means substantially perpendicularly to the plane made by the first and the second flat members and through one of the two exterior sheets of material to thereby secure the clip into at least one of the two modular panels.

5. The clip as in claim 4, further for securing a third modular panel perpendicularly to the first and the second modular panels, wherein the top plate is adapted to receive, through the third modular panel, a fastening means substantially perpendicularly to the plane made by the top plate.

6. The clip as in claim 1, wherein at least one of the first and the second pressure edges comprises at least one of an angled edge and a curved edge.

7. The clip as in claim 1, further comprising a third flat member and a fourth flat member respectively aligned with the first and the second flat members to prevent twisting of the clip in the assembly direction upon assembly of the two modular panels.

8. The clip as in claim 7, wherein the third and fourth flat members form a mirror image of the first and second flat members with respect to an insertion direction perpendicular to the assembly direction, thereby ensuring a reversibility of the clip.

9. The clip as in claim 7, wherein each one of the two modular panels comprises:

a foam layer partially enclosed by a first and a second exterior sheet of material each in a plane substantially parallel to the assembly direction;

a first female portion formed in the foam layer, near the first exterior sheet of material and comprising a first extension of the first exterior sheet of material; and a second male portion formed in the foam layer, near the second exterior sheet of material and comprising a second extension of the exterior sheet of material, wherein the second male portion of the first one of the two modular panels is inserted into the first female portion of the second one of the two modular panels upon assembly of the two modular panels in the assembly direction.

10. The clip as in claim 9, wherein a pair of flat members formed by any one of the first and second flat members, and the third and fourth flat members, are respectively introduced into the second male portion on the first modular panel and the first female portion on the first modular panel near any one of the first and second exterior sheets of material of any one of the two modular panels.

11. The clip as in claim 1, wherein a single piece of metal which is die-cut and folded forms both the first and the second flat members.

12. The clip as in claim 11, wherein the single piece of metal is folded again over itself to form a top plate linking the first and the second flat members.

13. The clip as in claim 1, two pieces of metal which are each die-cut and folded to respectively form the first and the second flat members.

14. The clip as in claim 13, wherein the two pieces of metal are fixed together by at least one of welding, riveting, gluing to form a top plate which joins the first flat member to the second flat member.

15. The clip as in claim 1, wherein the first pressure edge comprises a first portion having a first slope and a second portion having a second slope different from the first slope.

16. The clip as in claim 15, wherein the top plate is generally in a plane and the second slope is substantially perpendicular to the plane thereby providing a cam effect upon completing the introduction of the clip in the modular panel.

17. The clip as in claim 1, wherein the top plate is generally in a plane and wherein at least a portion of the varying slope is substantially perpendicular to the plane thereby providing a cam effect upon completing the introduction of the clip in the modular panel.

18. The clip as in claim 2, wherein the second pressure edge has a varying slope.

19. The clip as in claim 2, wherein the second pressure edge comprises a first portion having a first slope and a second portion having a second slope different from the first slope.

20. The clip as in claim 1, wherein at least one of the first flat member and the second flat member comprises an opening.

* * * * *